US005974594A

United States Patent [19]

Schweizer

[11] Patent Number: 5,974,594

[45] Date of Patent: Nov. 2, 1999

[54] PROTECTIVE OVERLAY FOR TOILET SEATS

[75] Inventor: Paul Schweizer, Unterengstringen, Switzerland

[73] Assignee: Linmark AG, Bern, Switzerland

[21] Appl. No.: 08/793,165

[22] PCT Filed: Jun. 5, 1996

[86] PCT No.: PCT/CH96/00217

§ 371 Date: Feb. 6, 1997

§ 102(e) Date: Feb. 6, 1997

[87] PCT Pub. No.: WO96/41563

PCT Pub. Date: Dec. 27, 1996

[30] Foreign Application Priority Data

Jun. 9, 1995 [CH] Switzerland ..... 1698/95

[51] Int. Cl.[6] ..... A47K 13/16

[52] U.S. Cl. ..... 4/245.8

[58] Field of Search ..... 4/245.8

[56] References Cited

U.S. PATENT DOCUMENTS

| | | | |
|---|---|---|---|
| 3,251,219 | 5/1966 | Mitsumori | 4/245.8 |
| 5,658,230 | 8/1997 | Schweizer | 493/405 |

FOREIGN PATENT DOCUMENTS

| | | |
|---|---|---|
| 331631 | 2/1989 | European Pat. Off. . |
| 594953 | 7/1993 | European Pat. Off. . |
| WO 9405194 | 3/1994 | WIPO . |

*Primary Examiner*—Robert M. Fetsuga

*Attorney, Agent, or Firm*—Sughrue, Mion, Zinn, Macpeak & Seas, PLLC

[57] ABSTRACT

A protective overlay including an oblong band (12) of a folded, thin, flexible material, which is laid-onto the seat surface (4) of a toilet seat (3). The band (12) has a turned down edge (15) that is swung into a protruding position when the band (12) is unfolded. The band (12) also has two areas (17, 18) differently folded and tensing differently during unfolding in the longitudinal direction of the band (12).

9 Claims, 2 Drawing Sheets

FIG. 4
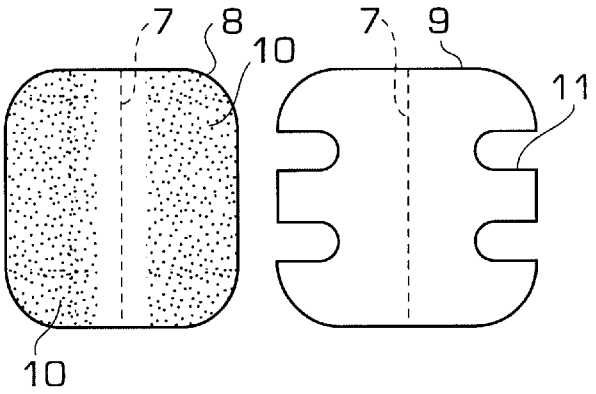
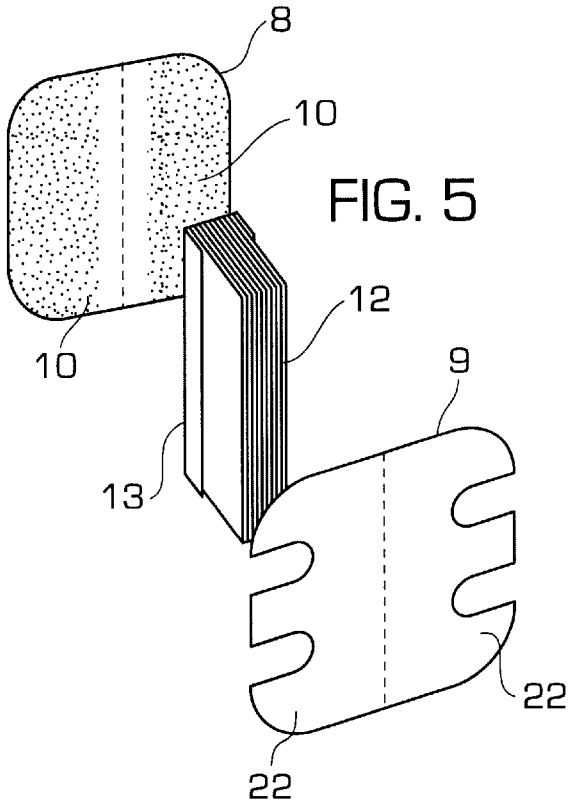
FIG. 5
FIG. 6
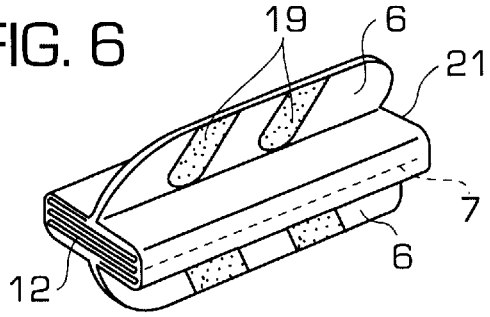

PROTECTIVE OVERLAY FOR TOILET SEATS

BACKGROUND OF THE INVENTION

1. Field of the Invention

The invention relates to a protective overlay for toilet seats, with an oblong band of a folded, thin, flexible foil, to be laid on the seat surface of a toilet seat, the band having a turned down edge that is swung into a protruding position when the band is unfolded.

2. Related Art

In the state of the art, a protective overlay of this kind was made known by EP-B-0 331 631 of the applicant. The inventor took on the technical problem of creating a protective overlay of this kind that is even easier to handle and is nevertheless secure for the user. The protective overlay should still be able to be manufactured inexpensively and be foldable into a small packet.

SUMMARY OF THE INVENTION

According to the invention, technical problem is solved, with a generic protective overlay, in that the band has at least two areas differently folded and tensing differently during unfolding in the longitudinal direction of the band. The invention is based on the idea of precisely setting the optimal tension of the protective overlay when unfolding and in the laid-on position, by the choice of the portions of different fold areas. The inventor thus recognized that the tension is quite essential to the handling of the protective overlay. With a band with only one type of fold, the tension when unfolding is predetermined and cannot be changed. With the invention, it is now possible to determine in a wide range the optimal tension by corresponding choice of the different fold areas. It is thus possible to create a protective overlay that has precisely the optimal tension. Consequently, excessive tension can be avoided, which, with the protective overlay laid on, could cause the gluing points to detach. Also avoidable is excessively low tension, with which the protective overlay would sag when unfolding the band and it would be very difficult to lay it on. Avoiding an excessive tension also has the essential advantage that the band lies flatter on the seat surface and thus less material is required.

According to a further development of the invention, at least one area has a cross-fold and the other area has at least one simple, so-called fanfold. This design has the essential advantage that in the packed state, the protective overlay has a more compact, smaller volume than a protective overlay consisting only of cross-folds. According to a further development of the invention, an optimal tension can be attained when simple folds and cross-folds alternate along the band. A design is also conceivable in which areas are provided with several adjacent cross-folds. If simple folds are used, the band can be formed as a rectangular strip. This is particularly advantageous since it facilitates production and mounting a cover.

Manufacturing the protective overlay according to the invention is particularly economical when it has a cover consisting of two separately produced sections. These sections can be rectangular, punched-out paper sections. According to a further development of the invention, a suitable cover can be easily produced in that a first section is connected, particularly glued, to one end and the other end of the band as well as to one end and the other end of a second section. The glued ends of the two sections can then form flaps that can be grasped by hand in order to tear the cover open along weakening lines. A fastening of the ends of the protective overlay on the seat surface is particularly easy to achieve when the ends of the second part have punched-out apertures that leave gluing points of the first section open. The cover then consists only of two separately produced sections. All essential functions are nevertheless fulfilled, particularly the easy grasping of the flaps, the undoing of the cover and the fastening of the protective overlay on the seat surface.

Further advantages are shown in the following description as well as the drawings.

BRIEF DESCRIPTION OF THE DRAWING FIGURES

An example of execution of the invention is explained in greater detail below with the aid of the drawings. They show:

FIG. 1 a view of a toilet seat with a protective overlay according to the invention laid on it, FIG. 2 a view of a packed protective overlay, FIG. 3 in diagram form, two partial views of differently unfolded bands, FIG. 4 a view of the two sections of the cover, FIG. 5 in diagram form, the mounting of the cover onto a folded band, and FIG. 6 another view of the packed protective overlay.

DETAILED DESCRIPTION OF THE PREFERRED EMBODIMENTS

Figure 1:
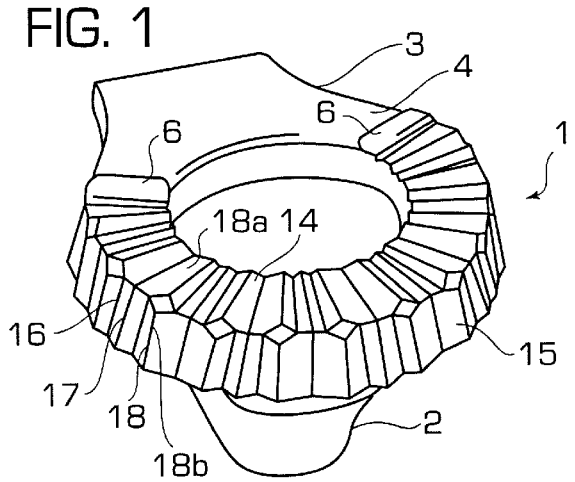

FIG. 1 shows a toilet bowl 2 with a seat 3 that has a seat surface 4 onto which a protective overlay 1 is laid. At its ends, the protective overlay 1 is attached on the seat 3 with two flaps 6 that each have on the bottom two gluing points 19 shown in FIG. 6. Between the two flaps 6 extends a band 12 that has an upper seat area 14 as well as an edge 15 protruding at right angles from it. Between the edge 15 and the area 14 there is an edge 16 that extends arched between the flaps 6 and that is folded as seen in FIG. 1.

Figure 3:
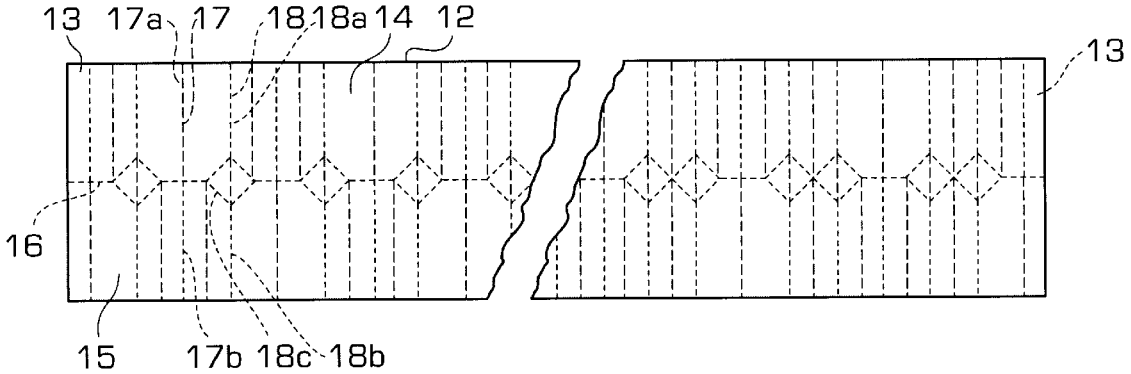

An exemplary fold can be seen particularly from FIGS. 1 and 3. It is essential that the fold has different areas with different tensions. In the example of execution shown, an area is formed by a simple fold 17. This consists of a fold line 17*a* of the area 14 as well as a fold line 17*b* in the edge 15. Both fold lines 17*a* and 17*b* are parallel and adjacent to each other when the protective overlay is packed. When unfolding the band 12, this fold 17 exerts only a slight tension. A comparably high level of tension is brought to bear by a so-called cross-fold 18, which includes fold lines 18*a* and 18*b* and, in the area of the edge 16, roughly squarely arranged fold lines 18*c*. This comparably complicated folding essentially has the effect that when unfolding the band 12, the edge 15 is swung into the protruding position. When the flaps 6 are extended, the edge 15 automatically swings into the desired protruding position. A band 12 of only such folds 18 would create a comparably high overall level of tension and bring to bear comparably intense traction forces on the flaps 6, in the position shown in FIG. 1. With an increase in the portion of the simple folds 17, the tension can thus be reduced. The tension is also dependent on the type of paper used, for example. Tissue paper, which dissolves in water comparably quickly and can be manufactured as recycling product, is preferably used. In practice, it has been show that with such a paper, optimal tension is achieved when, according to FIG. 3, the portions of the two folds are approximately equal. Also of interest is the now present possibility to develop the tension differently along the band 12.

Figure 2:
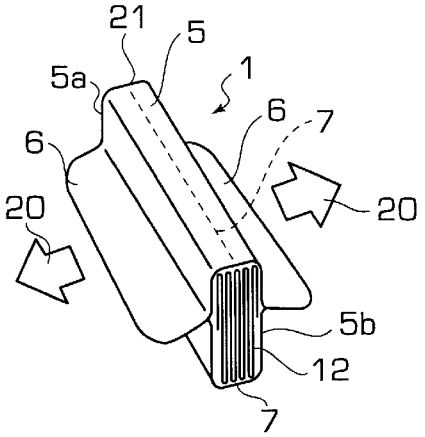

The band 12 is unfolded, in that the flaps 6 according to FIG. 2 are grasped by hand and extended in the direction of the arrows 20. In doing so, a cover 21 is separated into two equal sections along two perforation lines 7. These two sections 5*a* and 5*b* are each firmly connected, particularly glued, to an end 13 of the band 12. After separating the perforation lines 7, the band 12 is unfolded by extending the flaps 6, whereby the edge 15 is automatically swung into the protruding position and finally the unfolded protective overlay can be hid onto the seat 3. To attach the overlay 1, the flaps 6 are pressed with their bottom against the seat surface 4, where they adhere by means of the gluing points 19.

According to FIGS. 4 through 6, the cover 21 consists of only two individually produced, punched sections 8 and 9, each having a perforation line 7 running through the middle. The one section 8 is provided on one side with a gluing surface 10 which, as can be seen, is recessed in strip-form in the area of the perforation line 7. The other section 9 has four punched-out apertures 11, but no gluing surface. FIG. 5 shows in diagram form the folded band 12, onto which the two sections 8 and 9 to form the cover 21 are mounted. In this connection, the gluing surface 10 connects with the two ends 13 of the band 12 as well as with the punched-out ends of the section 9. FIG. 6 shows the finished protective overlay, whereby in this instance, only the flaps 6 are still swung inward until they come to rest.

I claim:

1. A protective overlay for toilet seats, comprising:

an oblong band (12) made of a folded, thin, flexible material, to be laid on a seat surface (4) of a toilet seat (3), said band (12) having a turned down edge (15) that is swung into a protruding position when said band (12) is unfolded, wherein said band (12) has two areas (17, 18) differently folded and tensing differently during unfolding in a longitudinal direction of said band (12).

2. A protective overlay according to claim 1, wherein one of said areas (18) has at least one cross-fold and another one of said areas has at least one simple fold.

3. A protective overlay according to claim 1, wherein said two areas (17, 18) alternate in the longitudinal direction of said band (12).

4. A protective overlay according to claim 1, wherein said band (12) is a rectangular strip.

5. A protective overlay according to claim 1, further comprising a cover (21) made of two separate sections (8, 9).

6. A protective overlay according to claim 5, wherein a first one of said sections (8) is connected to opposite ends (13) of said band (12) as well as to opposite ends (22) of a second one of said sections (9).

7. A protective overlay according to claim 6, wherein said first one of said sections (8) has an adhesive to connect said first one of said sections (8) to said opposite ends (13) of said band (12) as well as to said opposite ends (22) of said second one of said sections (9).

8. A protective overlay according to claim 6, wherein said two sections (8, 9) form flaps (6) that can be grasped by hand in order to tear said cover (21) open along weakening lines (7) formed in each of said two sections (8, 9).

9. A protective overlay according to claim 7, wherein said opposite ends (22) of said second one of said sections (9) have punched-out apertures (11) that expose portions (19) of the first section (9) having the adhesive.

* * * * *